US012049741B2

(12) United States Patent
Kumbhar et al.

(10) Patent No.: US 12,049,741 B2
(45) Date of Patent: Jul. 30, 2024

(54) TILT BUCKET

(71) Applicant: DEERE & COMPANY, Moline, IL (US)

(72) Inventors: Nilesh T. Kumbhar, Pune (IN); Nicholas J. Rokusek, Dubuque, IA (US); Brett S. Graham, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/306,411

(22) Filed: May 3, 2021

(65) Prior Publication Data

US 2022/0349148 A1 Nov. 3, 2022

(51) Int. Cl.

| | |
|---|---|
| ***E02F 3/40*** | (2006.01) |
| ***E02F 3/34*** | (2006.01) |
| ***E02F 3/36*** | (2006.01) |
| *E02F 9/28* | (2006.01) |

(52) U.S. Cl.
CPC ..... *E02F 3/40* (2013.01); *E02F 3/3414* (2013.01); *E02F 3/3677* (2013.01); *E02F 9/2808* (2013.01)

(58) Field of Classification Search
CPC ..... E02F 3/3414; E02F 3/3677; E02F 3/40; E02F 9/2808
See application file for complete search history.

(56) References Cited

U.S. PATENT DOCUMENTS

| | | | | |
|---|---|---|---|---|
| 3,941,262 | A | 3/1976 | Moser et al. | |
| 4,243,355 | A * | 1/1981 | Brudi | B66F 9/125 475/14 |
| 5,116,189 | A * | 5/1992 | Shammout | E02F 3/401 414/722 |
| 5,403,144 | A | 4/1995 | Staben, Jr. | |
| 5,562,398 | A * | 10/1996 | Knutson | E02F 3/3677 414/732 |
| 5,729,920 | A * | 3/1998 | Taylor | A01F 25/2027 37/409 |
| 5,938,399 | A | 8/1999 | Knutson | |
| 6,360,459 | B1 * | 3/2002 | Brookhart | E02F 3/345 37/234 |
| 6,579,058 | B1 | 6/2003 | Sales, Jr. | |
| 9,631,755 | B2 | 4/2017 | Behr et al. | |
| 10,480,152 | B1 * | 11/2019 | Smith | E02F 3/3686 |

(Continued)

FOREIGN PATENT DOCUMENTS

| | | | | |
|---|---|---|---|---|
| EP | 2862980 A1 | 4/2015 | | |
| WO | WO-2010047754 A2 * | 4/2010 | | B66F 9/125 |

*Primary Examiner* — Saul Rodriguez
*Assistant Examiner* — Brendan P Tighe
(74) *Attorney, Agent, or Firm* — Michael Best & Friedrich LLP

(57) ABSTRACT

A bucket assembly for use with a piece of construction equipment, the bucket assembly including a bucket including a base wall with a leading edge, where the bucket defines a bucket width, and a bucket frame pivotably coupled to the bucket and configured to be mounted to the piece of construction equipment, where the bucket frame defines a pivot axis about which the bucket pivots relative to the bucket frame over a pre-determined range of motion, where the pivot axis is parallel to the base wall of the bucket and perpendicular to the leading edge of the bucket, and where the pivot axis is centered along the bucket width.

12 Claims, 13 Drawing Sheets

(56) References Cited

U.S. PATENT DOCUMENTS

| | | | | |
|---|---|---|---|---|
| 2008/0181756 | A1* | 7/2008 | Moffitt | B66F 9/184 37/406 |
| 2009/0096190 | A1* | 4/2009 | Sharp | E02F 3/3677 280/727 |
| 2016/0230367 | A1 | 8/2016 | Hendron et al. | |
| 2019/0127945 | A1* | 5/2019 | Babl | E02F 3/42 |
| 2020/0181871 | A1 | 6/2020 | Kumbhar et al. | |

* cited by examiner

TILT BUCKET

FIELD OF THE INVENTION

The present disclosure relates to a tilt bucket assembly, and more specifically to a tilt bucket assembly having improved tilting characteristics.

BACKGROUND

During construction, skid steers and other forms of construction equipment are typically used to grade surfaces. When doing so, the orientation of the bucket of the skid steer is typically limited by the movement and operation of the arms of the skid steer making it more difficult to obtain the desired surface contour.

SUMMARY

In one aspect, a bucket assembly for use with a piece of construction equipment, the bucket assembly including a bucket including a base wall with a leading edge, where the bucket defines a bucket width, and a bucket frame pivotably coupled to the bucket and configured to be mounted to the piece of construction equipment, where the bucket frame defines a pivot axis about which the bucket pivots relative to the bucket frame over a pre-determined range of motion, where the pivot axis is parallel to the base wall of the bucket and perpendicular to the leading edge of the bucket, and where the pivot axis is centered along the bucket width.

In another aspect, a bucket assembly for use with a piece of construction equipment, the bucket assembly including a bucket including a base wall with a leading edge and a second wall extending from the base wall opposite the leading edge, and where the second wall defines a bucket height and a bucket width, a bucket frame pivotably coupled to the bucket and configured to be mounted to the piece of construction equipment, where the bucket is pivotable relative to the bucket frame about a pivot axis, a first actuator extending between and coupled to both the bucket and the bucket frame, where the first actuator defines a first length, and where adjusting the first length causes the bucket to pivot relative to the bucket frame, a second actuator extending between and coupled to both the bucket and the bucket frame, where the second actuator defines a second length, and where adjusting the second length causes the bucket to pivot relative to the bucket frame, and where the bucket height and the bucket width together define a bucket envelope extending parallel to the axis of rotation, and where both the first actuator and the second actuator are completely positioned within the bucket envelop.

In another aspect, a skid steer including a body, a conveyance structures rotatably mounted to the body, an arm, the arm having a first end pivotably coupled to the body and a second end opposite the first end, a bucket frame coupled to the second end of the arm, where the bucket base at least partially encloses a bucket base volume, a bucket pivotably coupled to the bucket base for rotation with respect to the bucket frame about a first pivot axis, where the bucket includes a base wall with a leading edge, a first actuator extending between and coupled to both the bucket and the bucket frame, where the first actuator defines a first length, and where adjusting the first length causes the bucket to pivot relative to the bucket frame, a second actuator extending between and coupled to both the bucket and the base, where the second actuator defines a second length, and where adjusting the second length causes the bucket to pivot relative to the base, and where the first actuator and the second actuator are completely positioned within the first volume.

In another aspect, a skid steer defining a support plane, the skid steer including a body defining a longitudinal axis, a conveyance structure rotatably mounted to the body, an arm, the arm having a first end pivotably coupled to the body and a second end opposite the first end, a bucket frame coupled to the second end of the arm, a bucket pivotably coupled to the bucket base for rotation with respect to the bucket frame about a first pivot axis over a first range of motion, where the bucket includes a base wall with a leading edge, and where the leading edge remains perpendicular to the longitudinal axis over the entire first range of motion when the arm is positioned such that the base wall is parallel to the support plane.

Other aspects of the disclosure will become apparent by consideration of the detailed description and accompanying drawings.

DETAILED DESCRIPTION

Figure 1A:
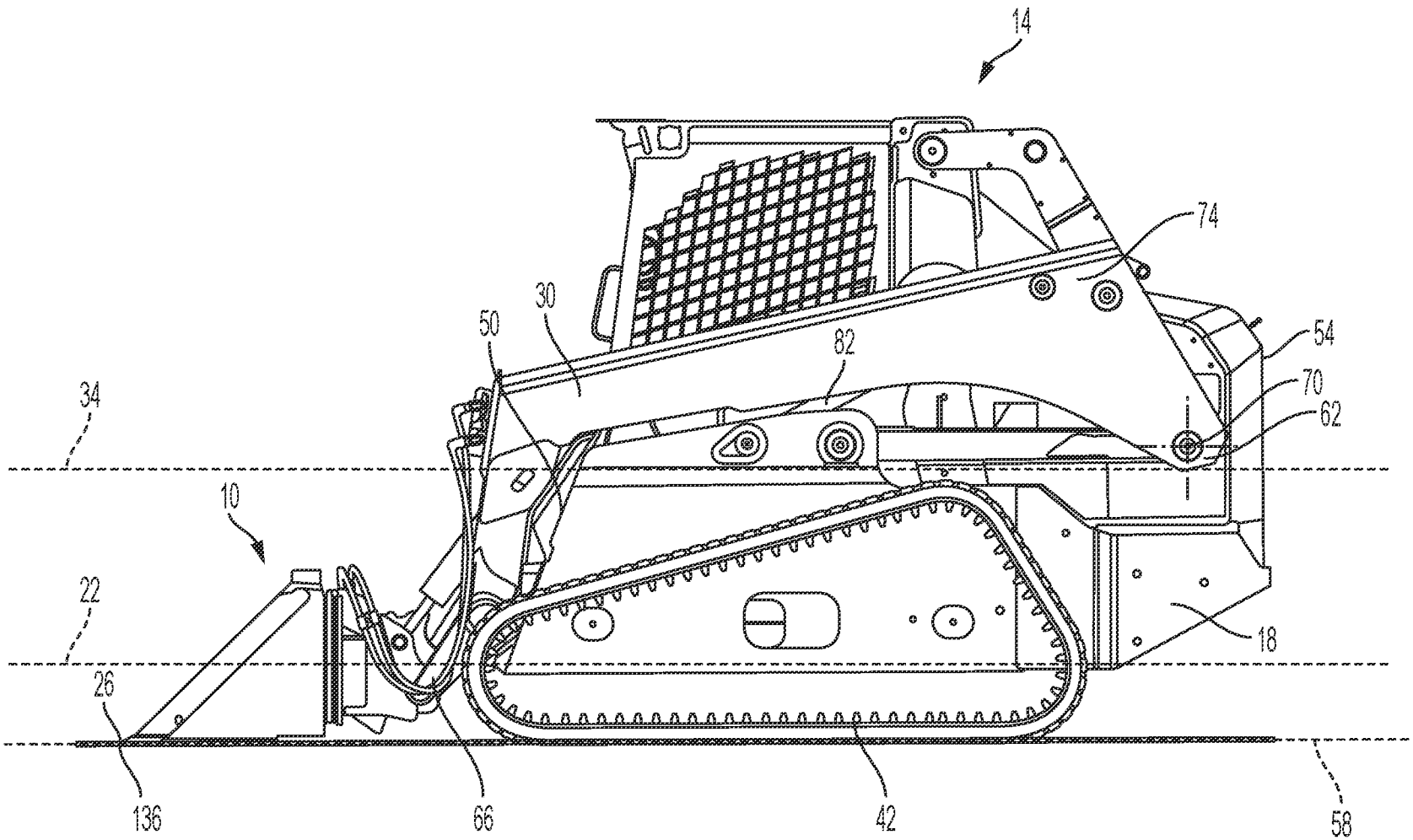
FIG. 1A is a side view of a piece of construction equipment with a tilt bucket assembly mounted thereon.

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

FIGS. 1A-11 illustrate a tilt bucket assembly 10 for use with a piece of construction equipment such as a skid steer 14 and the like. During use, the tilt bucket assembly 10 is configured to rotate relative to the body 18 of the skid steer 14 about an axis 22 such that the leading edge 26 of the bucket assembly 10 can be re-oriented laterally independent of the operation of the arm assembly 30 of the skid steer 14 between a first position (see FIG. 1B) and a second position (see FIG. 1C). More specifically, the tilt bucket assembly 10 is configured so that the leading edge 26 can rotate through its entire range of motion (see FIGS. 1B and 1C), while held in the home position by the arm assembly 30, and remain perpendicular to a longitudinal axis 34 of the skid steer 14. For the purposes of this application, the "home position" is the position of the arm assembly 30 when the base wall plane 128 (described below) of the bucket 100 is coincident with the support surface plane 58 when the bucket 100 is in a level orientation.

The skid steer 14 includes a body or frame 18, a conveyance structure 42 (e.g., wheels and/or a track) rotatably coupled to the frame 18, and an arm assembly 30 pivotably coupled to the body or frame 18 for movement with respect thereto. As shown in FIG. 1A, the body 18 of the skid steer 14 includes a forward end 50, and a rearward end 54 opposite the forward end 50. The skid steer 14 also defines a longitudinal axis 34 centered about the width of the body 18 and extending along the length thereof (e.g., from the forward end 50 to the rearward end 54; see FIG. 1A). The skid steer 14 also defines a support surface plane 58 generally defined by the bottom of the conveyance structure 42.

Figure 1B:
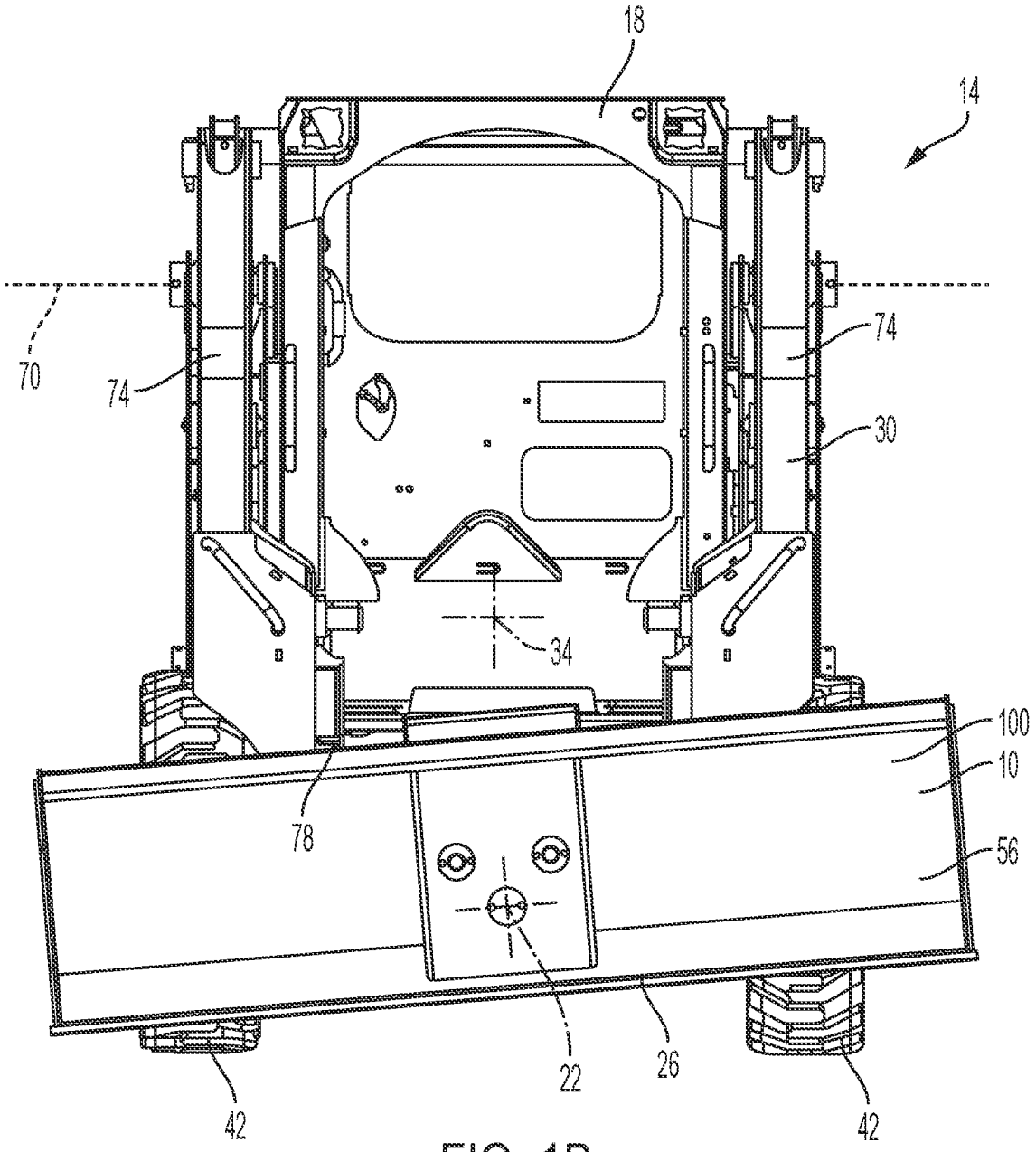
FIG. 1B is a front view of the piece of construction equipment and tilt bucket assembly of FIG. 1A with the tilt bucket assembly in a first position.
Figure 1C:
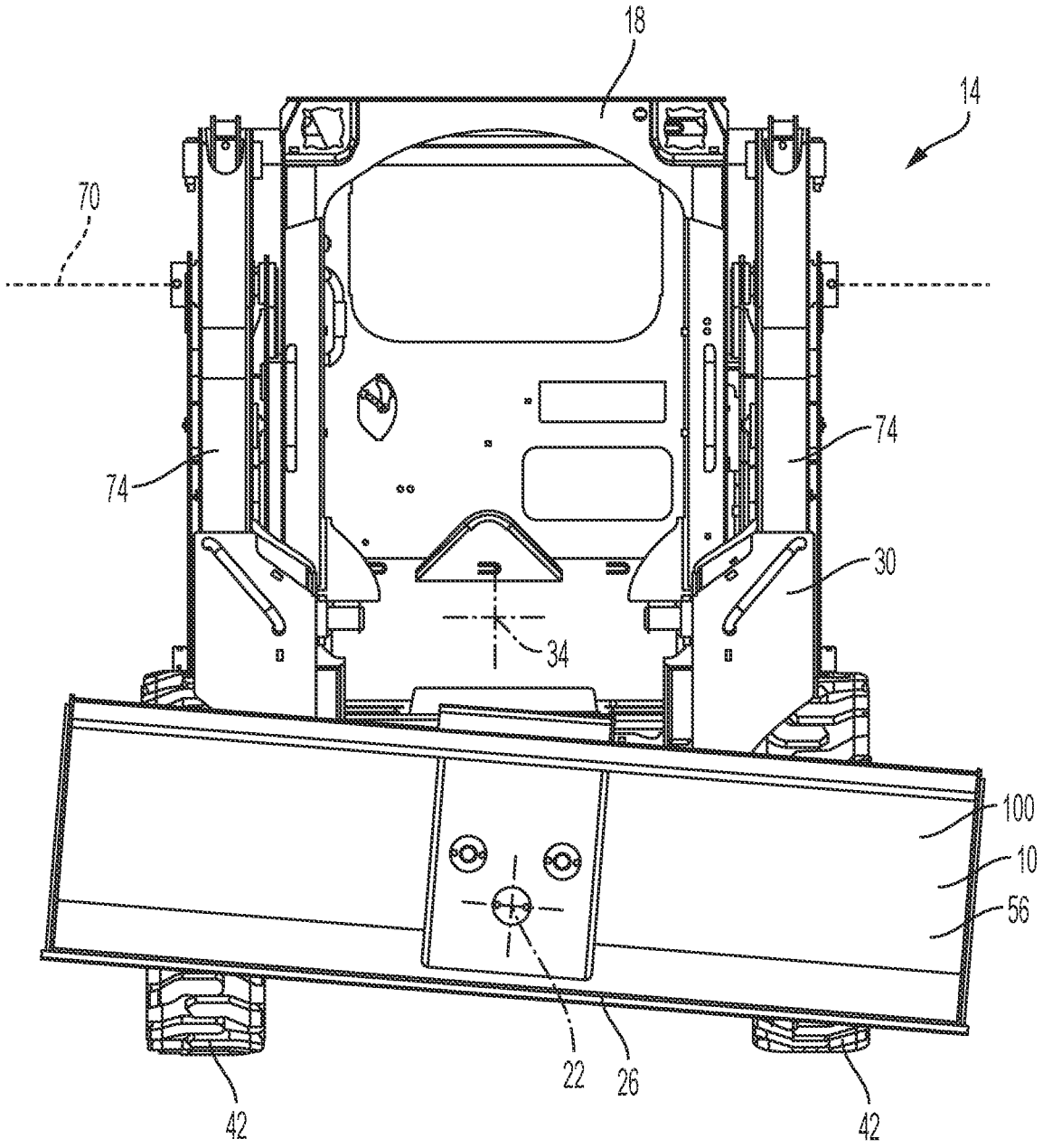
FIG. 1C is a front view of the piece of construction equipment and tilt bucket assembly of FIG. 1A with the tilt bucket assembly in a second position.

The arm assembly 30 of the skid steer 14 is substantially elongated in shape and includes a first end 62 pivotably coupled to the body 18, and a second end 66 opposite the first end 62 that is configured to act as a mounting point for the tilt bucket assembly 10. As shown in FIGS. 1A-1C, the first end 62 of the arm 30 is pivotably mounted to the body 18 of the skid steer 14 proximate the rearward end 54 thereof for rotation about an arm axis 70 that is oriented perpendicular to the longitudinal axis 34.

In the illustrated embodiment, the arm assembly 30 includes a pair of individual arms 74 each disposed on either side of the body 18 and interconnected by one or more cross-members 78 (see FIGS. 1B and 1C). However, in alternative embodiments more or fewer individual arms 74 or cross members 78 may be present. The illustrated arm assembly 30 also includes one or more actuators 82 (e.g., hydraulic cylinders, see FIG. 1A) extending between and coupled to both the arm assembly 30 and the body 18. During use, the actuators 82 are configured to transmit forces between the arm assembly 30 and the body 18 to cause the arm assembly 30 to rotate about the arm axis 70 relative to body 18. While in some embodiments the arm assembly 30 may include a substantially rigid structure along its entire length, in the illustrated embodiment the arm assembly 30 includes one or more sub-sections between the first end 62 and the second end 66 that are capable of articulating relative to one another.

The tilt bucket assembly 10 includes a bucket 100 and a bucket frame 104 pivotably coupled to the bucket 100 for rotation over a range of motion with respect thereto about a bucket pivot axis 22 independent of the operation of the arm assembly 30. More specifically, the bucket 100 pivots about the pivot axis 22 between a first position (FIG. 1B) and a second position (FIG. 1C). During use, the bucket frame 104 is mounted to the second end 66 of the arm assembly 30 so that articulation of the arm assembly 30 may re-position the bucket assembly 10 vertically (e.g., changes the vertical position of the bucket assembly 10 as a whole relative to the support surface plane 58). Once in a vertical position set by the arm assembly 30, the tilt bucket assembly 10 may then laterally pivot the bucket 100 independently therefrom. As described above, one vertical position includes the "home position."

As shown in FIGS. 2-11, the tilt bucket assembly 10 is configured to provide a compact assembly with improved tilting characteristics. More specifically, the tilt bucket assembly 10 is configured to tilt such that, when the bucket assembly 10 is in the home position, the leading edge 26 of the bucket 100 remains perpendicular to the longitudinal axis 34 of the skid steer 14 over the entire range of tilting motion (e.g., from the first position to the second position, see FIGS. 1B and 1C).

The bucket 100 of the bucket assembly 10 includes a rigid body 56 at least partially forming a concave bucket volume 112 into which aggregate such as gravel or other materials may be collected during use. The bucket 100 includes a base wall 116 defining the leading edge 26, an anchor wall 120 extending upwardly from the base wall 116 opposite the leading edge 26, and a pair of side walls 124 at least partially enclosing the sides of the bucket 100.

The bucket 100 also defines an overall bucket height 102, and an overall bucket width 106 both measured perpendicular to the pivot axis 22. Together, the overall bucket height 102 and the overall bucket width 106 define the cross-sectional extent of a bucket envelope 110 that extends along the pivot axis 22.

Figure 2:
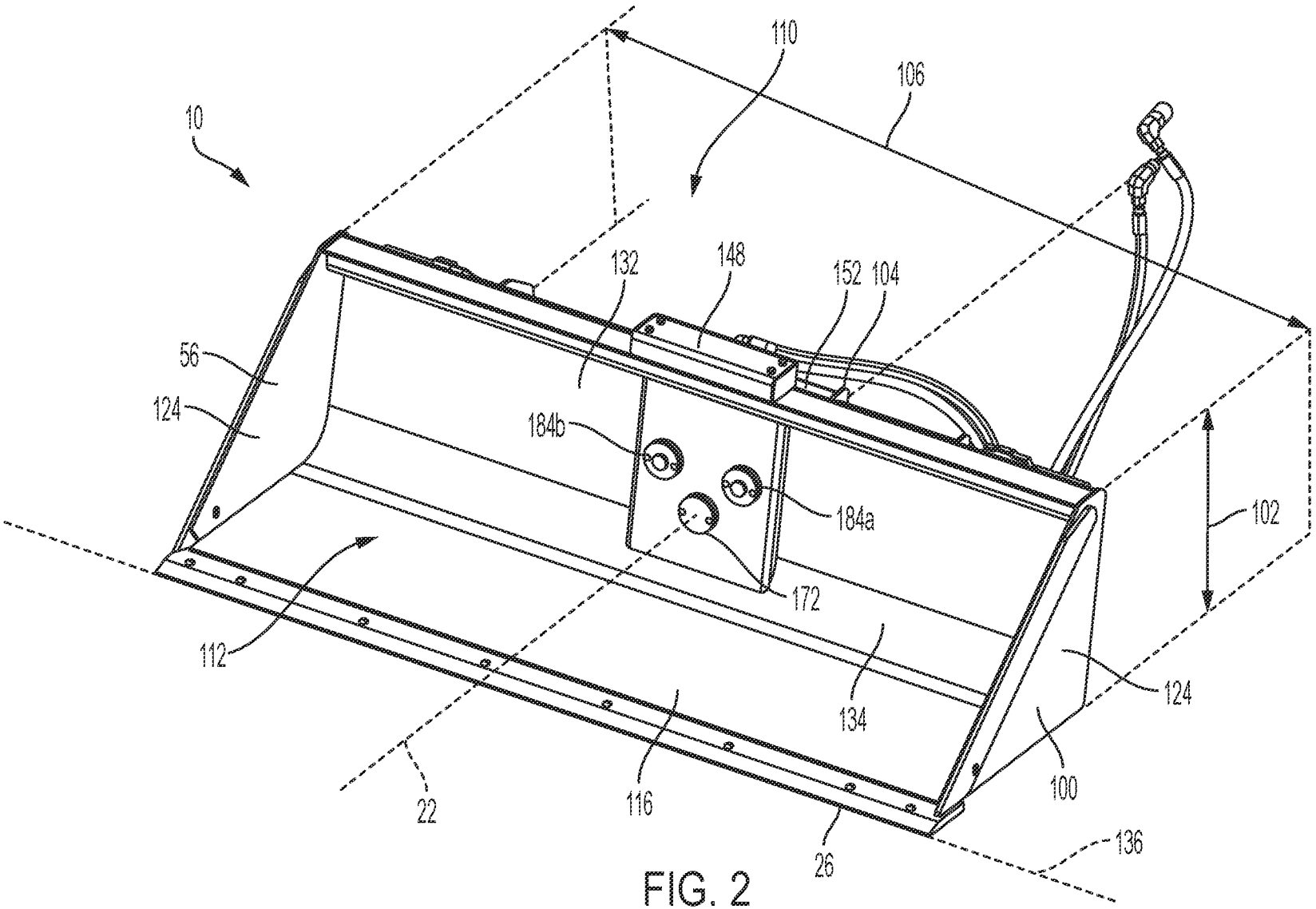
FIG. 2 is a perspective view of the tilt bucket assembly of FIG. 1A.
Figure 3:
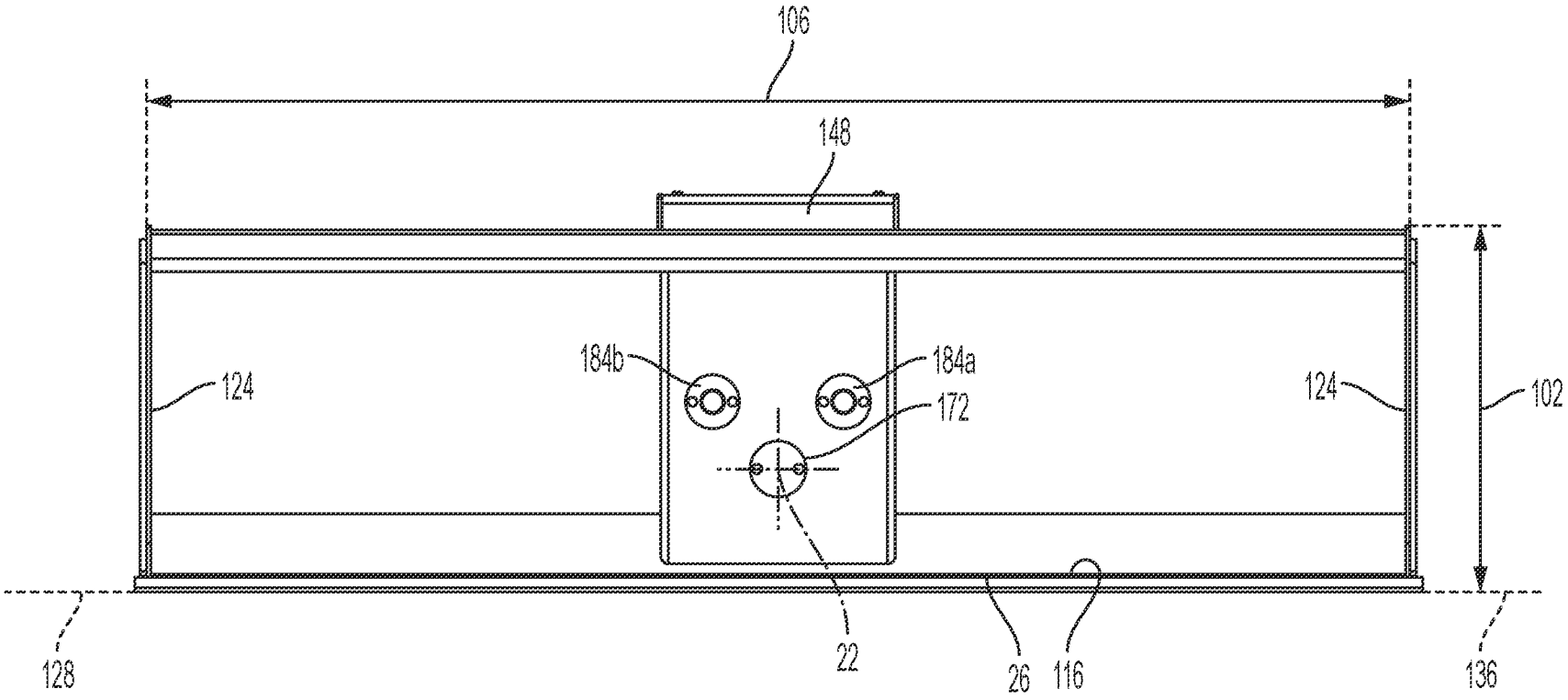
FIG. 3 is a front view of the tilt bucket assembly of FIG. 1A.
Figure 4:
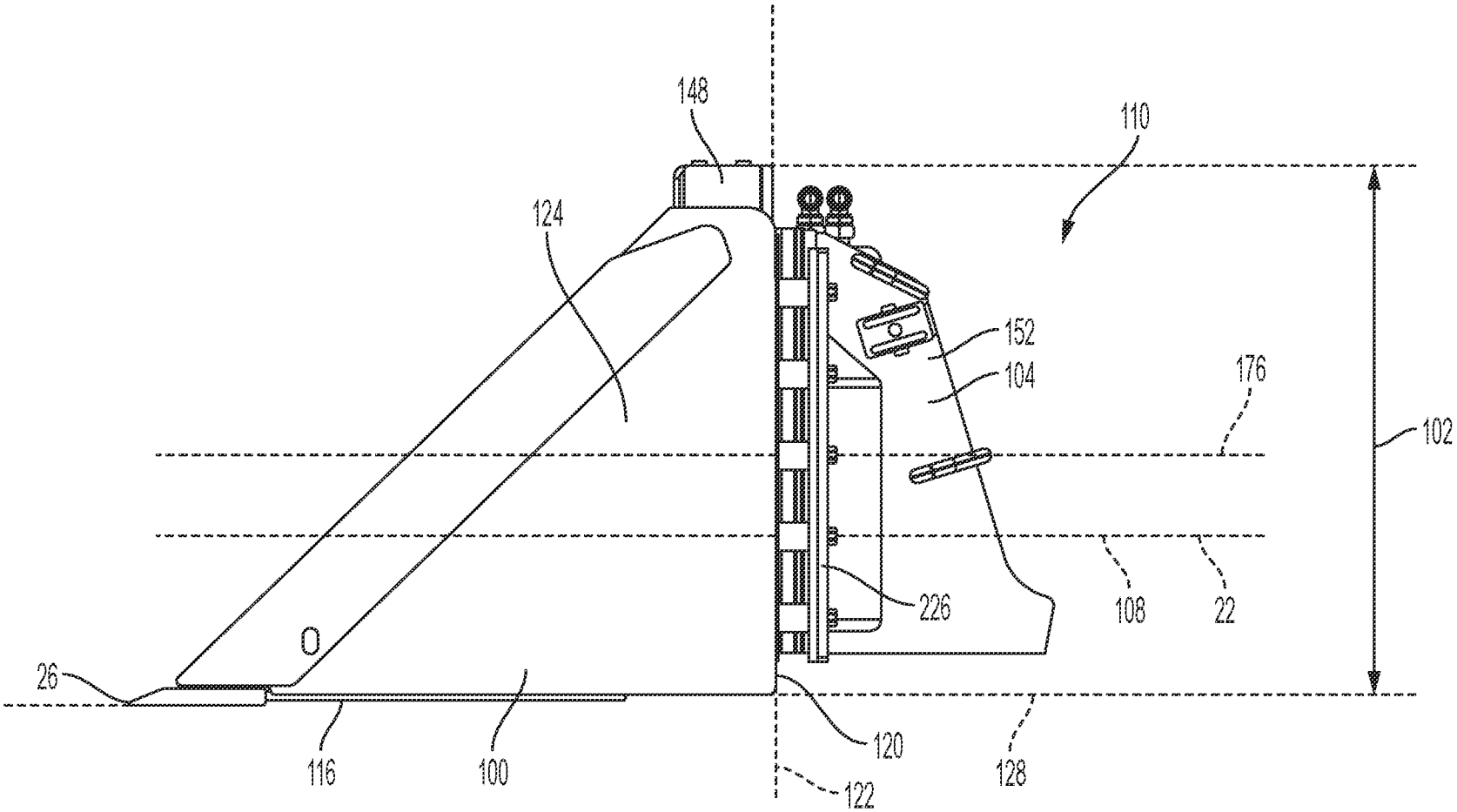
FIG. 4 is a side view of the tilt bucket assembly of FIG. 1A.
Figure 5:
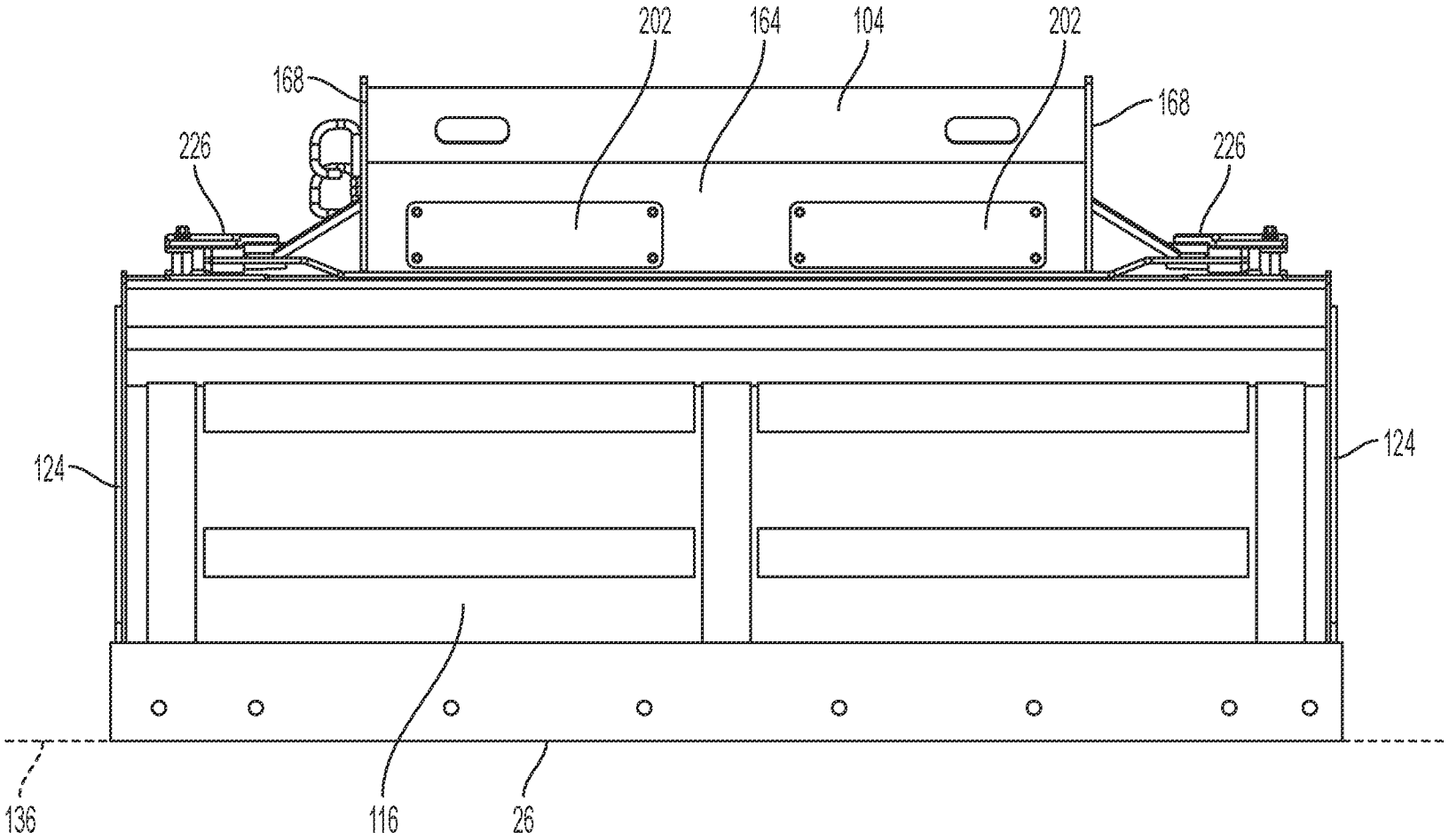
FIG. 5 is a bottom view of the tilt bucket assembly of FIG. 1A.
Figure 6:
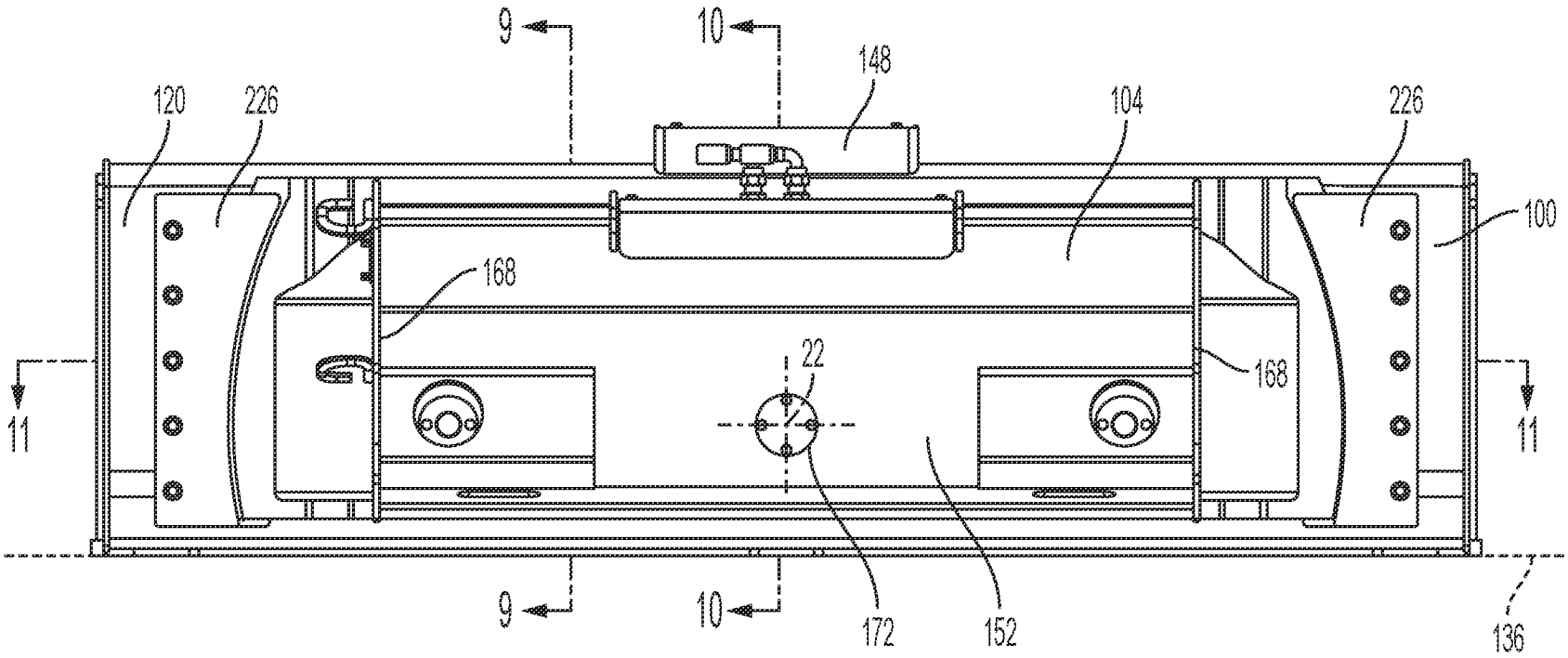
FIG. 6 is a rear view of the tilt bucket assembly of FIG. 1A.
Figure 7:
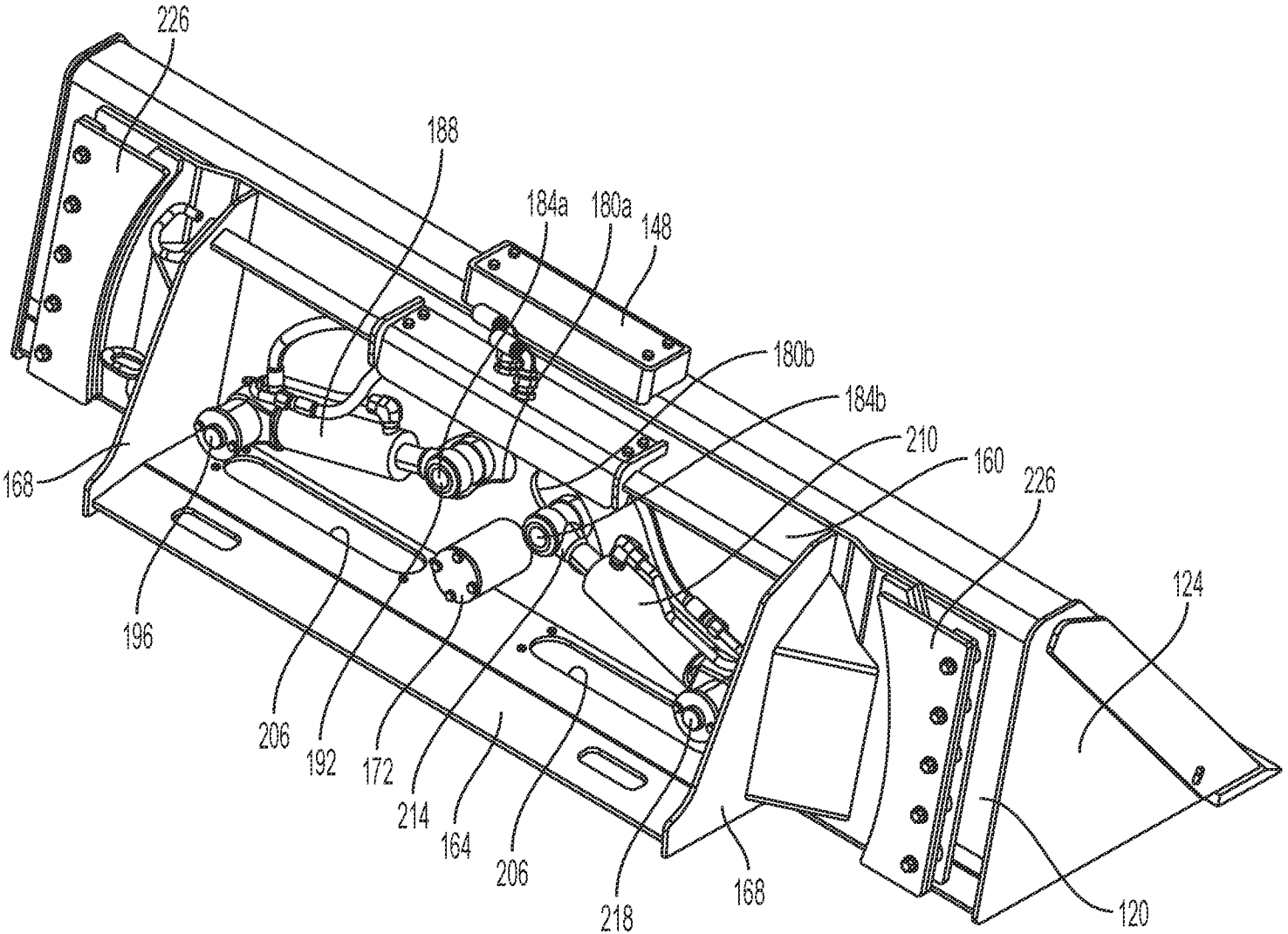
FIG. 7 is a rear perspective view of the tilt bucket assembly of FIG. 1A with a portion of the bucket frame removed.

As shown in FIGS. 2 and 4, the base wall 116 of the bucket 100 is substantially planar and defines a base wall plane 128 while the anchor wall 120 is also substantially planar and defines an anchor wall plane 122. In the illustrated embodiment, the bucket 100 is shaped such that the anchor wall plane 122 is perpendicular to the base wall plane 128. Furthermore, the anchor wall plane 122 is generally normal to the bucket pivot axis 22 while the base wall plane 128 is parallel to the bucket pivot axis 22.

Figure 9:
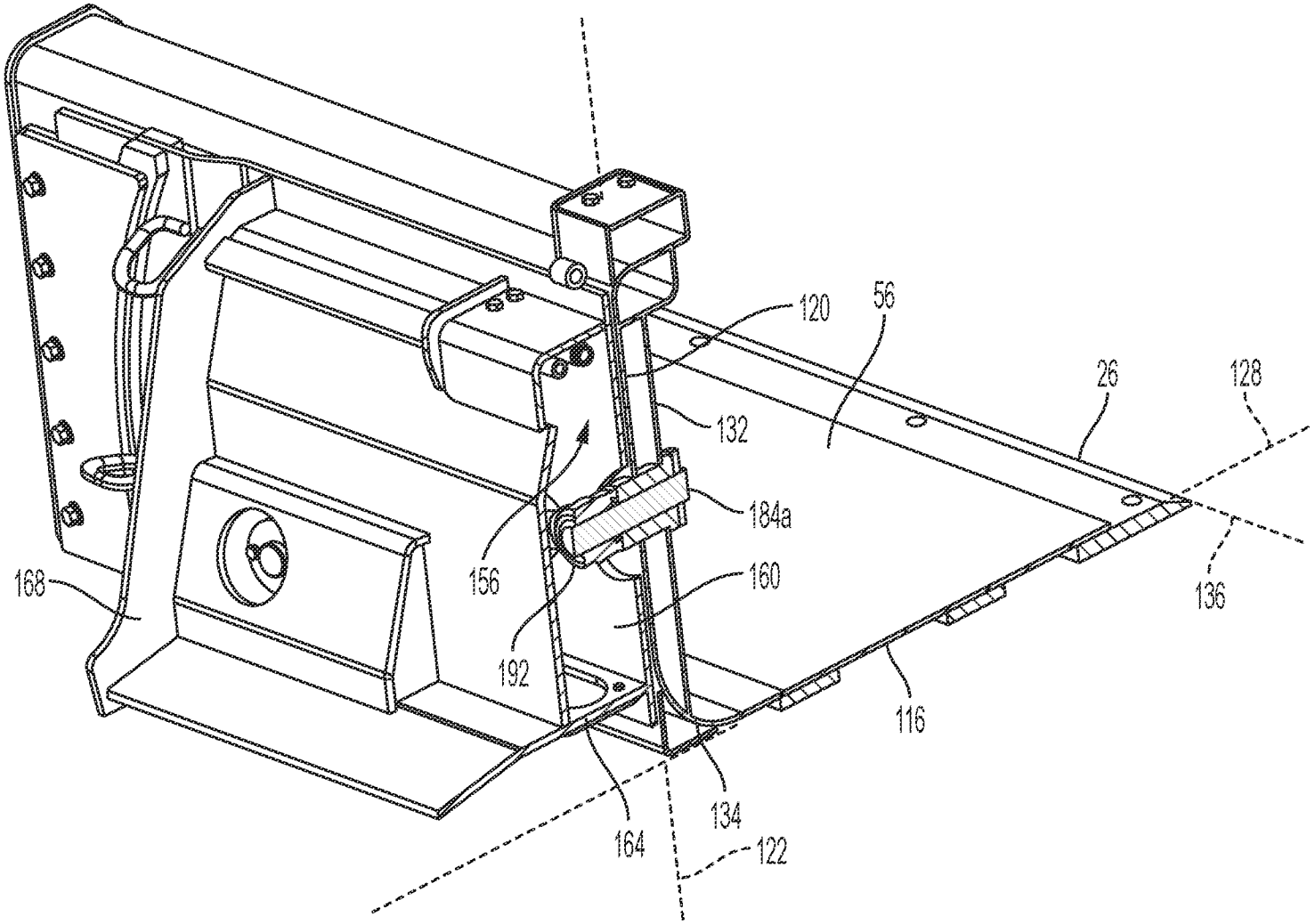
FIG. 9 is a section view taken along line 9-9 of FIG. 6.
Figure 10:
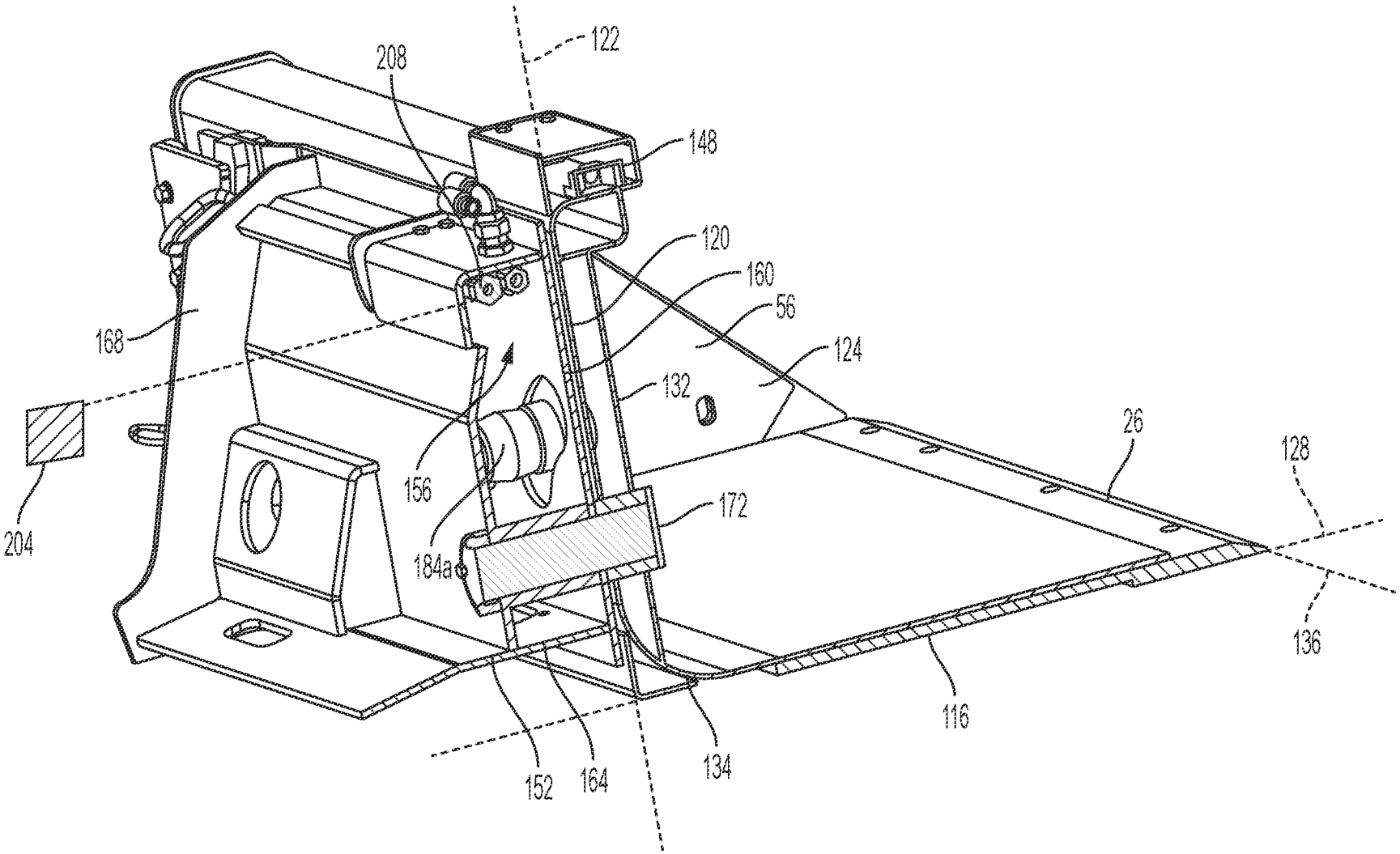
FIG. 10 is a section view taken along line 10-10 of FIG. 6.
Figure 11:
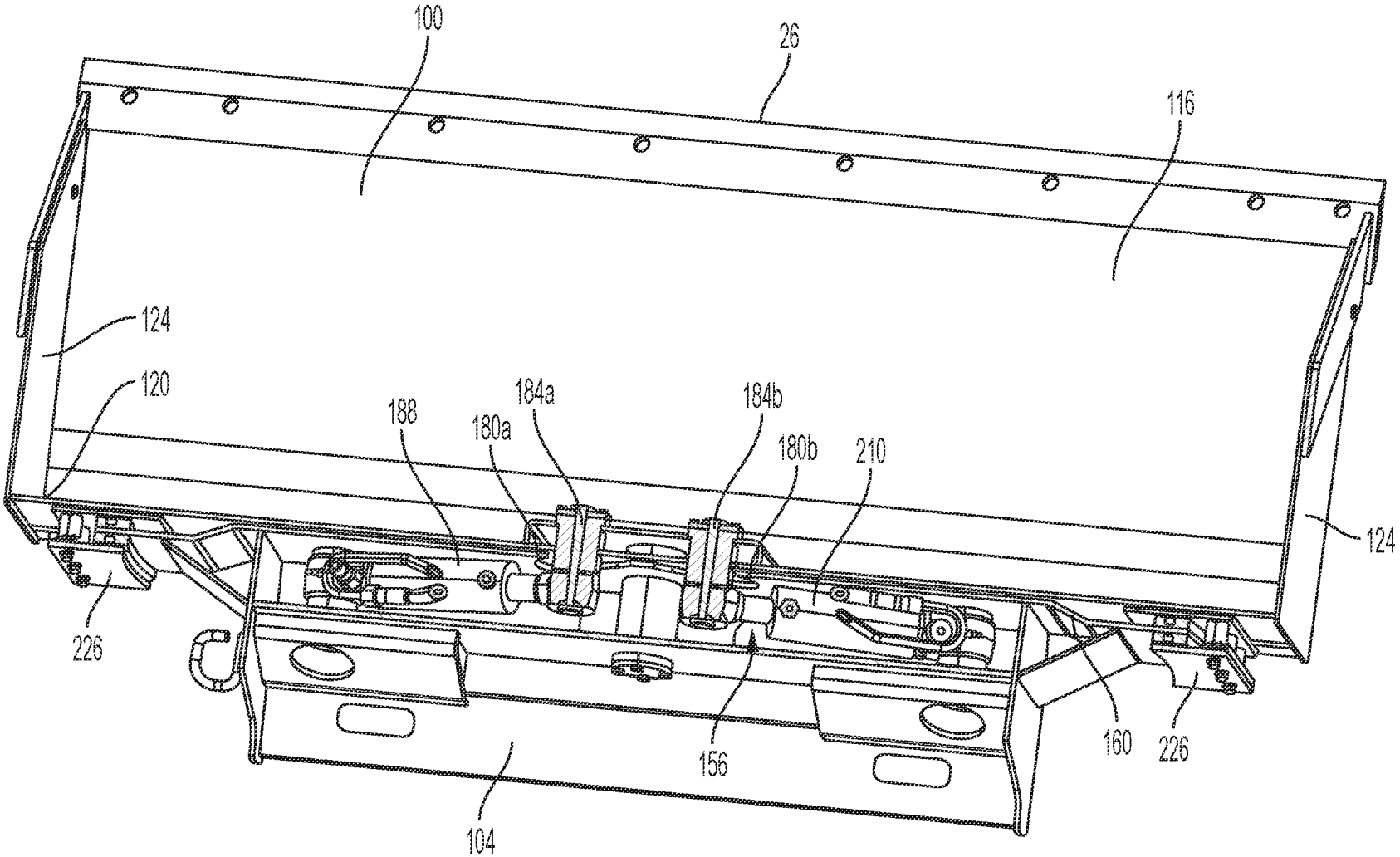
FIG. 11 is a section view taken along line 11-11 of FIG. 6.

In the illustrated bucket 100, the base wall 116 transitions into the anchor wall 120 via a radiused transition portion 134 (see FIGS. 9-10). However, it is understood that in alternative embodiments the base wall 116 and the anchor wall 120 may come together at a hard corner (e.g., such as a welded seam, creased edge, and the like). In still other embodiments, other transitions between the base wall 116 and the anchor wall 120 may be present.

The leading edge 26 of the base wall 116 extends substantially the entire width of the bucket 100 defining a leading edge axis 136 therethrough. During use, the leading edge 26 is configured to initially engage the aggregate and direct the material into the bucket volume 112. In the illustrated embodiment, the leading edge 26 is substantially linear; however, in alternative embodiments the leading edge 26 may have teeth, grooves, or other textures formed therein. In still other embodiments, separate teeth may be coupled to the leading edge 26. In the illustrated embodiment, the leading edge 26 is oriented so that the leading edge axis 136 is coincident with the base wall plane 128 and perpendicular to the pivot axis 22.

The bucket 100 also includes a reinforcing wall 132 positioned parallel to and spaced a distance from the anchor wall 120. During use, the anchor wall 120 and reinforcing wall 132 work together provide support for the pivot assembly 172 and mounting points 184*a*, 184*b* (described below). More specifically, the reinforcing wall 132 is positioned forward of the anchor wall 120 (e.g., between the anchor wall 120 and the leading edge 26) and extends the entire width of the bucket 100. However, in alternative embodiments, more or fewer reinforcing walls 132 may be included as needed to provide sufficient support and strength to the bucket 100 itself.

As shown in FIG. 10, the bucket 100 also includes an orientation sensor 148 fixedly coupled thereto. During use, the orientation sensor 148 is configured to move together with the body 56 of the bucket 100 and output signals indicating the orientation of the leading edge axis 136 relative to a horizontal datum. While not illustrated, additional sensors may be present or the orientation sensor 148 may be configured to output additional signals representative of the relative rotational angle between the bucket 100 and the bucket frame 104, the position of the arm assembly 30, and the like.

The bucket frame 104 of the bucket assembly 10 is a structural member extending between and coupled to both the second end 66 of the arm assembly 30 and the bucket 100. The bucket frame 104 includes a body 152 at least partially enclosing a first volume 156 therein. More specifically, the illustrated bucket frame 104 includes a first wall 160 positioned adjacent to and parallel the anchor wall 120 of the bucket 100, a second wall 164 extending from the first wall 160 proximate the bottom thereof, and a pair of side walls 168 extending from the first wall 160 and oriented substantially vertically. The bucket frame 104 also includes a plurality of additional walls and reinforcing members configured to substantially enclose the first volume 156 and provide reinforcement and strength for the bucket frame 104.

The bucket frame 104 also includes a pivot member 172 extending between and coupled to both the bucket frame 104 and the bucket body 56 to establish the pivot axis 22 therebetween. More specifically, the pivot member 172 is coupled to both the bucket 100 and bucket frame 104 so that the bucket 100 is fixed and supported radially relative to the bucket frame 104 (e.g., transmitting forces therebetween) while being able to rotate about the pivot axis 22 with respect thereto. In the illustrated embodiment, the pivot member 172 is positioned such that the pivot axis 22 is parallel to the base wall plane 128 and perpendicular to the leading edge axis 136. Furthermore, the pivot member 172 is positioned such that the pivot axis 22 is positioned between a first datum 176 and the base wall plane 128 when the first datum 176 is positioned midway along the bucket height 102 (see FIG. 8). Still further, the pivot member 172 is positioned such that the pivot axis 22 is positioned coincident with a second datum 108 positioned approximately at $\frac{1}{3}^{rd}$ of the overall bucket height 102 taken relative to the base wall 116. Laterally, the pivot axis 22 is centered along the overall bucket width 106.

Figure 8:
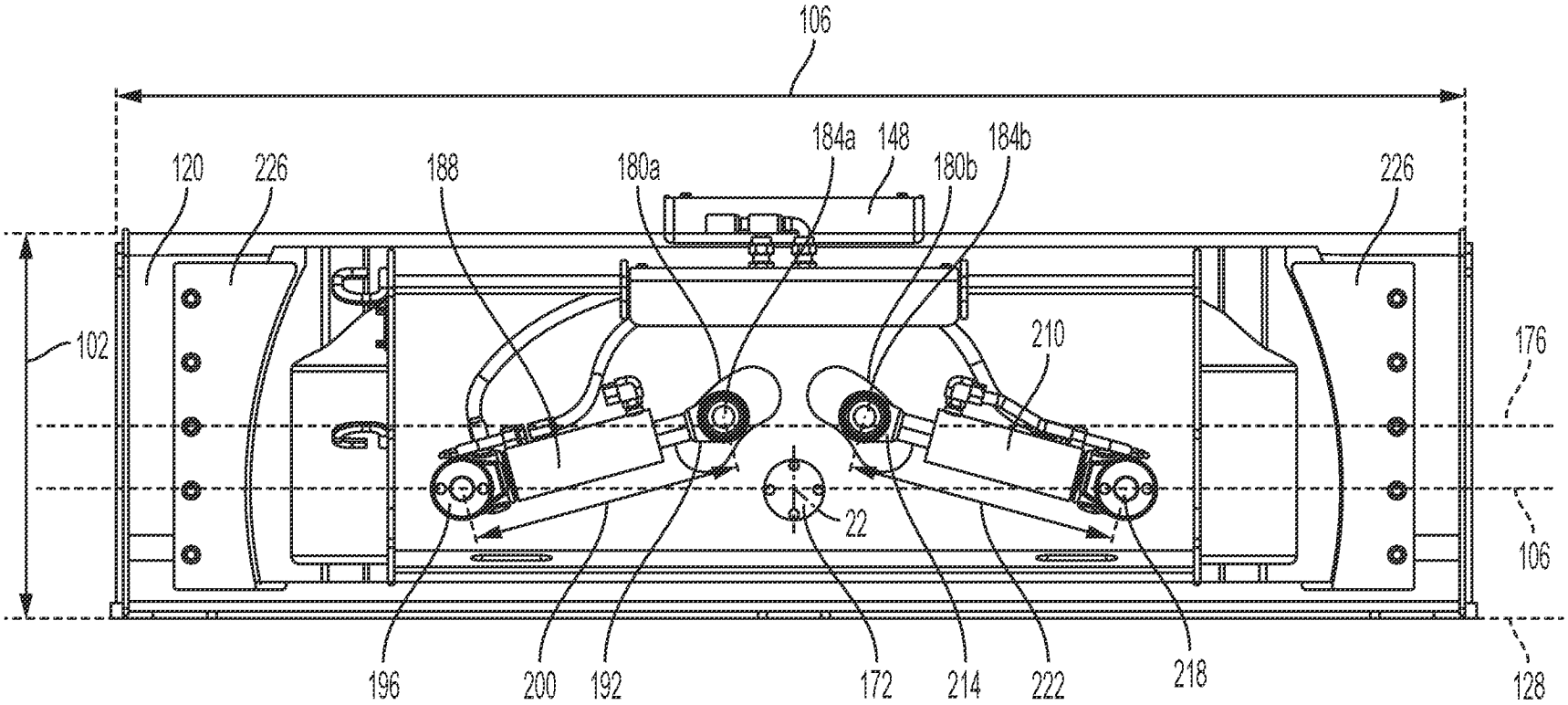
FIG. 8 is a rear view of the tilt bucket assembly of FIG. 7.

As shown in FIG. 8, the first wall 160 of the bucket frame 104 defines a pair of slots 180*a*, 180*b* open to the first volume 156 and adjacent the anchor wall 120 of the bucket 100. During use, each slot 180*a*, 180*b* is configured to allow first and second mounting points 184*a*, 184*b*, each of which are fixedly coupled to the bucket body 56, to extend through a corresponding slot 180*a*, 180*b* such that forces may be transmitted to the bucket body 56 via the mounting points 184*a*, 184*b* from inside the first volume 156. In the illustrated embodiments, each slot 180*a*, 180*b* is substantially arcuate in shape producing a curve that is centered on the pivot axis 22. During use, each mounting point 184*a*, 184*b* travels along its corresponding slot 180*a*, 180*b*, respectively, as the bucket 100 pivots relative to the bucket frame 104 about the pivot axis 22 between the first and second positions.

The bucket frame 104 also includes a pair of access panels 202 to selectively provide access to the first volume 156. More specifically, the bucket frame 104 includes a pair of access panels 202 each configured to selectively cover an access port 206 formed into the bucket frame 104 and open to the first volume 156. When the access panels 202 are coupled to the frame 104, they restrict access to the first volume 156; however, by removing the panel 202 the user may then gain access to the first volume 156 for maintenance and the like. In the illustrated embodiment, each access port 206 is formed in the second wall 164 of the bucket frame 104 and substantially aligned with a corresponding one of actuating members 188, 210 (described below). More specifically the access ports 206 are generally axially aligned, relative to the pivot axis 22, with a corresponding one of the actuating members 188, 210.

The bucket assembly 10 also includes a pair of alignment plates 226 coupled to the bucket body 56 and configured to slidingly engage the bucket frame 104. More specifically, the two plates 226 are oriented substantially normal to the pivot axis 22 and positioned so that they clamp a portion of the bucket frame 104 between the plates 226 and the bucket 100. The resulting joint allows the bucket 100 to rotate relative to the bucket frame 104 while helping to strengthen the connection therebetween.

The bucket assembly 10 also includes a first actuating member 188 extending between and coupled to both the bucket 100 and the bucket frame 104. More specifically, the first actuating member 188 includes a first end 192 coupled to the bucket frame 104, and a second end 196 opposite the first end 192 that is coupled to the first mounting point 184*a*. The first actuating member 188 also defines a first actuator length 200 that extends between the first end 192 and the second end 196. In the illustrated embodiment, the first actuating member 188 is a hydraulic cylinder; however, in alternative embodiments different types of actuator (e.g., electrical, pneumatic, and the like) may be used. During use, a controller 204 sends signals to a hydraulic system 208 (described below) that provides hydraulic fluid to the first actuating member 188 causing the first actuator length 200 to increase or decrease. The change in the first actuator length 200, in turn, causes the bucket 100 to pivot about the pivot axis 22 with respect to the bucket frame 104.

The bucket assembly 10 also includes a second actuating member 210 extending between and coupled to both the bucket 100 and the bucket frame 104. More specifically, the second actuating member 210 includes a first end 214 coupled to the bucket frame 104, and a second end 218 opposite the first end 214 that is coupled to the second mounting point 184*b*. The second actuating member 210 also defines a second actuator length 222 that extends between the first end 214 and the second end 218. In the illustrated embodiment, the second actuating member 210 is a hydraulic cylinder; however, in alternative embodiments different types of actuator (e.g., electrical, pneumatic, and the like) may be used. During use, the controller 204 sends signals to the hydraulic system 208 that provides hydraulic fluid to the second actuating member 210 causing the second actuator length 222 to increase and decrease. The change in the second actuator length 222, in turn, causes the bucket 100 to pivot about the pivot axis 22 with respect to the bucket frame 104.

In the illustrated embodiment, both the first actuating member 188 and the second actuating member 210 are positioned completely within the first volume 156 of the bucket frame 104 over the entire pivoting range of the bucket assembly 10. Furthermore, the first actuating member 188 and the second actuating member 210 are positioned so that both are completely positioned within the bucket envelope 110 over the entire pivoting range of the bucket assembly 10.

The bucket assembly 10 also includes a controller 204 configured to receive information from the orientation sensor 148 and user, input the information into one or more control algorithms, and output signals to control the first and second actuator lengths 200, 222 of the first and second actuating members 188, 210 to control the rotational position of the bucket 100 relative to the bucket frame 104 (e.g., the bucket tilt angle). More specifically, the controller 204 is configured to output signals to a hydraulic system 208 which, in turn, is configured to selectively provide hydraulic fluid to the first and second actuating members 188, 210 causing the first and second actuator lengths 200, 222 to change. The changes in lengths 200, 222 then cause the bucket 100 to rotate about the pivot axis 22 relative to the bucket frame 104 as described above.

To rotate the bucket 100 relative to the bucket frame 104, the user may first input a particular desired bucket tilt angle or the controller 204 may automatically output signals to achieve a desired bucket tilt angle based on one or more inputs from the orientation sensor 148. With the desired bucket tilt angle decided, the controller 204 then outputs signals to the hydraulic system 208 which, in turn, directs hydraulic fluid to both the first and second actuating members 188, 210.

As the hydraulic fluid is directed to the actuating members 188, 210, the actuating members 188, 210 work in concert to pivot the bucket 100 about the pivot axis 22 relative to the bucket frame 104 over the entire pivot range. More specifically, the actuating members 188, 210 are oriented so that one actuating member increases in length while the other actuating member proportionally decreases in length to cause the desired motion. In the illustrated embodiment, the controller 204 and hydraulic system 208 are configured to provide hydraulic fluid to the first and second actuating members 188, 210 in appropriate proportions and manners in order to coordinate the change in the first actuator length 200 and the change in the second actuator length 222.

With the actuating members 188, 210 changing in length, the force produced by each member 188, 210 is transmitted from to the bucket body 56 via the first and second mounting points 184*a*, 184*b*. By doing so, the actuating members 188, 210 are able to transmit forces to the bucket 100 while being completely concealed and protected within the confines of the first volume 156. The orientation also permits the actuating members 188, 210 to remain within the bucket envelope 110 over the entire range of motion which results in a much smaller footprint for the entire system 10, minimizing the chances of interference during the grading process.

In the illustrated embodiment, the hydraulic system 208 receives pressurized fluid from the skid steer 14. However, in alternative embodiments the system 208 may be independently operable having its own pump and accumulators as needed.

The invention claimed is:

1. A skid steer defining a support plane, the skid steer comprising:

a body defining a longitudinal axis;

a plurality of wheels rotatably mounted to the body;

an arm, the arm having a first end pivotably coupled to the body and a second end opposite the first end;

a bucket frame coupled to the second end of the arm;

a bucket pivotably coupled to the bucket frame for rotation with respect to the bucket frame, wherein the bucket includes a base wall with a leading edge defining a leading edge axis and configured to engage material to be worked, and wherein the base wall defines a base wall plane; and wherein the bucket is positionable in a home position by the arm in which the base plane is coincident with the support plane, wherein the bucket may be rotated with respect to the bucket frame about the first pivot axis while the arm remains in the home position to establish a first range of motion, and wherein the bucket is shaped such that the leading edge axis remains perpendicular to the longitudinal axis over the entire first range of motion.

2. The skid steer of claim 1, wherein the bucket includes a second wall extending from the base wall opposite the leading edge, and a pair of side walls each extending between the base wall and the second wall, and wherein the base wall is oriented perpendicular to the second wall.

3. The skid steer of claim 2, wherein the bucket includes a second wall extending from the base wall opposite the leading edge, and wherein the axis of rotation is normal to the second wall.

4. The skid steer of claim 1, wherein the pivot axis is parallel to the base wall of the bucket and perpendicular to the leading edge axis of the bucket, wherein the bucket defines a bucket width, and wherein the pivot axis is centered along the bucket width.

5. The skid steer of claim 1, wherein the bucket defines a bucket height and a first datum centered along the bucket height, and wherein the pivot axis is positioned between the first datum and the base wall.

6. The skid steer of claim 1, wherein the bucket defines a bucket height, a first datum at $1/3^{rd}$ the overall bucket height relative to the base wall, and a second datum at $2/3^{rd}$ the overall bucket height relative to the base wall, and wherein the pivot axis is coincident with the first datum.

7. The skid steer of claim 1, further comprising a first actuator coupled to and extending between the bucket and the bucket frame, wherein the first actuator defines a first length, and wherein changing the first length causes the bucket to pivot relative to the base about the pivot axis.

8. The skid steer of claim 7, further comprising a second actuator coupled to and extending between the bucket and the bucket frame, wherein the second actuator defines a second length, and wherein changing the second length causes the bucket to pivot relative to the base about the pivot axis.

9. The skid steer of claim 8, wherein the first length is configured to increase as the second length decreases.

10. The skid steer of claim 8, wherein the bucket frame at least partially defines a first volume therein, and wherein both the first actuator and the second actuator are completely positioned within the first volume.

11. The skid steer of claim 8, wherein the bucket defines a bucket height and a bucket width, and wherein the bucket height and the bucket width together define a bucket envelope extending parallel to the axis of rotation, and wherein the first actuator and the second actuator are completely positioned within the bucket envelope.

12. The skid steer of claim 1, wherein the leading edge is linear.

* * * * *